US010364631B2

(12) United States Patent
Xu et al.

(10) Patent No.: US 10,364,631 B2
(45) **Date of Patent: *Jul. 30, 2019**

(54) DOWNHOLE ASSEMBLY INCLUDING DEGRADABLE-ON-DEMAND MATERIAL AND METHOD TO DEGRADE DOWNHOLE TOOL

(71) Applicants: Zhiyue Xu, Cypress, TX (US); James Doane, Friendswood, TX (US); Yingqing Xu, Tomball, TX (US); Zhihui Zhang, Katy, TX (US)

(72) Inventors: Zhiyue Xu, Cypress, TX (US); James Doane, Friendswood, TX (US); Yingqing Xu, Tomball, TX (US); Zhihui Zhang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 103 days.

This patent is subject to a terminal disclaimer.

(21) Appl. No.: 15/599,031

(22) Filed: May 18, 2017

(65) Prior Publication Data

US 2018/0171737 A1 Jun. 21, 2018

Related U.S. Application Data

(63) Continuation-in-part of application No. 15/385,021, filed on Dec. 20, 2016.

(51) Int. Cl.
*E21B 29/02* (2006.01)
*F42D 1/045* (2006.01)
(Continued)

(52) U.S. Cl.
CPC ..... *E21B 29/02* (2013.01); *E21B 33/1204* (2013.01); *E21B 34/10* (2013.01);
(Continued)

(58) Field of Classification Search
CPC ..... E21B 29/02; E21B 31/002; F42D 1/04; F42D 1/045; F42D 1/05
(Continued)

(56) References Cited

U.S. PATENT DOCUMENTS 6,253,843 B1 7/2001 Rawson et al.
7,270,191 B2 9/2007 Drummond et al.
(Continued)

FOREIGN PATENT DOCUMENTS

WO 2013022635 A2 2/2013

OTHER PUBLICATIONS

"Spectre Disintegrating Frac Plug", Baker Hughes, 2015, 8 Pages.
(Continued)

*Primary Examiner* — Kenneth L Thompson
(74) *Attorney, Agent, or Firm* — Cantor Colburn LLP

(57) ABSTRACT

A downhole assembly includes a downhole tool including a degradable-on-demand material including: a matrix material; and, an energetic material configured to generate energy upon activation to facilitate the degradation of the downhole tool; and, a triggering system including: an electrical circuit having an open condition and a closed condition, the electrical circuit configured to be in the closed condition after movement of an object downhole that engages directly or indirectly with the triggering system; and, an igniter within the electrical circuit, the igniter arranged to ignite the downhole tool in the closed condition of the electrical circuit. In the open condition of the electrical circuit the igniter is inactive, and in the closed condition of the electrical circuit the igniter is activated.

24 Claims, 13 Drawing Sheets

(51) Int. Cl.

| | |
|---|---|
| ***E21B 33/12*** | (2006.01) |
| ***E21B 47/00*** | (2012.01) |
| ***E21B 34/10*** | (2006.01) |
| ***E21B 36/02*** | (2006.01) |
| *E21B 34/00* | (2006.01) |
| *E21B 47/06* | (2012.01) |

(52) U.S. Cl.
CPC ..... *E21B 36/02* (2013.01); *E21B 47/00* (2013.01); *E21B 47/06* (2013.01); *E21B 47/065* (2013.01); *E21B 2034/007* (2013.01)

(58) Field of Classification Search
USPC ..... 166/376
See application file for complete search history.

(56) References Cited

U.S. PATENT DOCUMENTS

| | | | | |
|---|---|---|---|---|
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,485,265 | B2 | 7/2013 | Marya et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,267,347 | B2 | 2/2016 | Agrawal et al. | |
| 9,656,926 | B1 * | 5/2017 | Thoma | E21B 33/12 |
| 9,689,247 | B2 | 6/2017 | Holder et al. | |
| 2007/0209802 | A1 | 9/2007 | Xu et al. | |
| 2013/0062055 | A1 * | 3/2013 | Tolman | E21B 23/00 166/250.01 |
| 2013/0081825 | A1 * | 4/2013 | Lynde | E21B 23/00 166/376 |
| 2013/0118805 | A1 * | 5/2013 | Moody-Stuart | E21B 43/117 175/2 |
| 2013/0160992 | A1 | 6/2013 | Agrawal et al. | |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0345878 | A1 * | 11/2014 | Murphree | C09K 8/703 166/377 |
| 2014/0363692 | A1 | 12/2014 | Marya et al. | |
| 2015/0021023 | A1 | 1/2015 | Roberts et al. | |
| 2015/0027723 | A1 | 1/2015 | Fripp et al. | |
| 2015/0159468 | A1 | 6/2015 | Mailand | |
| 2015/0190984 | A1 | 7/2015 | Zhang et al. | |
| 2015/0239795 | A1 | 8/2015 | Doud et al. | |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0186044 | A1 | 6/2016 | Rothrock et al. | |
| 2016/0209391 | A1 | 7/2016 | Zhang et al. | |
| 2016/0333668 | A1 | 11/2016 | Xu et al. | |
| 2017/0009563 | A1 | 1/2017 | Holder | |
| 2017/0138169 | A1 | 5/2017 | Bogdan et al. | |
| 2017/0218722 | A1 | 8/2017 | Gordon et al. | |
| 2018/0171736 | A1 | 6/2018 | Xu et al. | |
| 2018/0171738 | A1 | 6/2018 | Xu et al. | |
| 2018/0171757 | A1 | 6/2018 | Xu | |
| 2018/0230769 | A1 | 8/2018 | Xu et al. | |
| 2018/0230770 | A1 | 8/2018 | Oag et al. | |
| 2018/0245448 | A1 | 8/2018 | Fripp et al. | |
| 2018/0252070 | A1 | 9/2018 | Zhu et al. | |
| 2018/0283119 | A1 | 10/2018 | Zhang et al. | |
| 2018/0283121 | A1 * | 10/2018 | Zhang | E21B 29/02 |
| 2018/0283141 | A1 * | 10/2018 | Zhang | E21B 41/0085 |
| 2018/0283142 | A1 * | 10/2018 | Zhang | E21B 41/0085 |
| 2018/0334873 | A1 | 11/2018 | Marya | |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US20171062275, dated Mar. 12, 2018, 4 pages.

Written Opinion of the International Search Report for International Application No. PCT/US2017/062275, dated Mar. 12, 2018, 12 pages.

* cited by examiner

DOWNHOLE ASSEMBLY INCLUDING DEGRADABLE-ON-DEMAND MATERIAL AND METHOD TO DEGRADE DOWNHOLE TOOL

CROSS REFERENCE TO RELATED APPLICATIONS

The present application is a continuation-in-part of U.S. patent application Ser. No. 15/385,021, filed Dec. 20, 2016, which is hereby incorporated by reference in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating or interventionless downhole tools have been developed. Instead of milling or drilling operations, these tools can be removed by dissolution of engineering materials using various wellbore fluids. Because downhole tools are often subject to high pressures, a disintegrable material with a high mechanical strength is often required to ensure the integrity of the downhole tools. In addition, the material must have minimal disintegration initially so that the dimension and pressure integrities of the tools are maintained during tool service. Ideally the material can disintegrate rapidly after the tool function is complete because the sooner the material disintegrates, the quicker the well can be put on production.

One challenge for the self-disintegrating or interventionless downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period and the change of tool dimensions during disintegration can cause difficulties in well operations and planning. An uncontrolled disintegration can also delay well productions. Therefore, the development of downhole tools that have minimal or no disintegration during the service of the tools so that they have the mechanical properties necessary to perform their intended function and then rapidly disintegrate in response to a customer command is very desirable. It would be a further advantage if such tools can also detect real time tool disintegration status and well conditions such as temperature, pressure, and tool position for tool operations and control.

BRIEF DESCRIPTION

A downhole assembly includes a downhole tool including a degradable-on-demand material including: a matrix material; and, an energetic material configured to generate energy upon activation to facilitate the degradation of the downhole tool; and, a triggering system including: an electrical circuit having an open condition and a closed condition, the electrical circuit configured to be in the closed condition after movement of an object downhole that engages directly or indirectly with the triggering system; and, an igniter within the electrical circuit, the igniter arranged to ignite the downhole tool in the closed condition of the electrical circuit. In the open condition of the electrical circuit the igniter is inactive, and in the closed condition of the electrical circuit the igniter is activated.

A method of controllably removing a downhole tool of a downhole assembly, the method including: starting a timer in a triggering system of the downhole assembly for a pre-selected time period, the downhole tool including degradable-on-demand material having a matrix material and an energetic material configured to generate energy upon activation to facilitate degradation of the downhole tool; disposing the downhole assembly in a downhole environment; determining if a downhole operation can be completed within the pre-selected time period, and extending the pre-selected time period if the downhole operation cannot be completed within the pre-selected time period; performing the downhole operation using the downhole assembly; activating the energetic material at an end of the pre-selected time period or at an end of an extended time period using the igniter; and degrading the downhole tool.

A frac plug includes: a body formed of a degradable-on-demand material, the degradable-on-demand material including: a matrix material; and, an energetic material configured to generate energy upon activation to facilitate the degradation of the downhole tool; a time delay fuse in contact with an uphole end of the body and in contact with the energetic material; and, a ball seat including a piezoelectric material at an uphole end of the time delay fuse; wherein the piezoelectric material is configured to create a spark and ignite the time delay fuse after a ball is seated on the ball seat and pressure is increased on the ball in a downhole direction.

BRIEF DESCRIPTION OF THE DRAWINGS

The following descriptions should not be considered limiting in any way. With reference to the accompanying drawings, like elements are numbered alike:

FIG. 6A illustrates a downhole article before activation; FIG. 6B illustrates the downhole article of FIG. 6A after activation; FIG. 6C illustrates an energetic material broken from the activated downhole article of FIG. 6B; FIG.

6D illustrates a matrix material broken from the activated downhole article of FIG. 6B; FIG. 6E illustrates a sensor material broken from the activated downhole article of FIG. 6B; and FIG. 6F illustrates a powder generated from the activated downhole article of FIG. 6B;

FIG. 7A illustrates the triggering system in an inactive state and FIG. 7B illustrates the triggering system in an active state;

DETAILED DESCRIPTION

Figure 1:
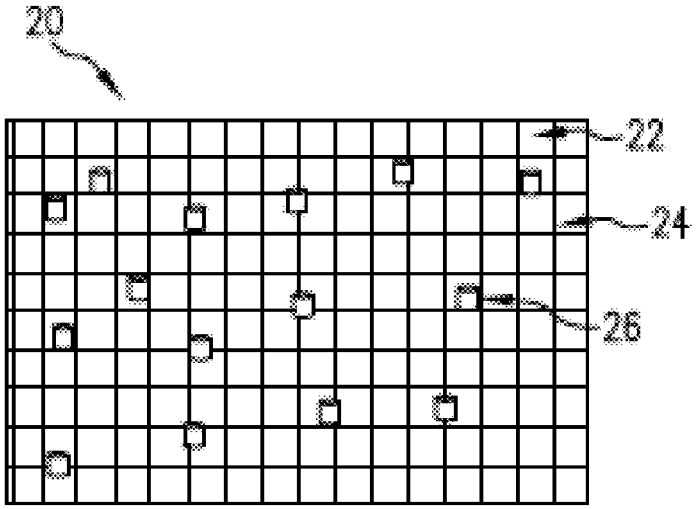
FIG. 1 is a schematic diagram of an exemplary downhole article that includes a matrix material, an energetic material, and a sensor, wherein the energetic material comprises interconnected fibers or wires.

The disclosure provides multifunctional downhole articles that can monitor tool degradation/disintegration status, tool positions and surrounding well conditions such as temperature, pressure, fluid type, concentrations, and the like. Meanwhile, the downhole articles have minimized disintegration rate or no disintegration while the articles are in service but can rapidly degrade in response to a triggering signal or activation command. The degradable downhole articles (alternatively termed disintegrable downhole articles where the degradable downhole articles have complete or partial disintegration) include a degradable-on-demand material including at least a matrix material and an energetic material configured to generate energy upon activation to facilitate the degradation of the degradable article; and may further include a sensor. The disintegration of the articles can be achieved through chemical reactions, thermal cracking, mechanical fracturing, or a combination comprising at least one of the foregoing.

The energetic material can be in the form of continuous fibers, wires, foils, particles, pellets, short fibers, or a combination comprising at least one of the foregoing. In the downhole articles, the energetic material is interconnected in such a way that once a reaction of the energetic material is initiated at one or more starting locations or points, the reaction can self-propagate through the energetic material in the downhole articles. As used herein, interconnected or interconnection is not limited to physical interconnection.

In an embodiment the energetic material comprises continuous fibers, wires, or foils, or a combination comprising at least one of the foregoing and forms a three dimensional network. The matrix material is distributed throughout the three dimensional network. A downhole article having such a structure can be formed by forming a porous preform from the energetic material, and filling or infiltrating the matrix material into the preform under pressure at an elevated temperature. The sensor can be placed at a random or a predetermined location in the downhole article.

In another embodiment, the energetic material is randomly distributed in the matrix material in the form of particles, pellets, short fibers, or a combination comprising at least one of the foregoing. A downhole article having such a structure can be formed by mixing and compressing the energetic material and the matrix material. The sensor can be placed at a random or a predetermined location in the downhole article.

In yet another embodiment, the downhole article comprises an inner portion and an outer portion disposed of the inner portion, where the inner portion comprises a core material that is corrodible in a downhole fluid; and the outer portion comprises the matrix material and the energetic material. The sensor can be disposed in the inner portion of the downhole article, the outer portion of the downhole article, or both. Illustrative core materials include corrodible matrix materials disclosed herein. The inner portion can include a core matrix formed from the core materials. Such a core matrix can have a microstructure as described herein for the corrodible matrix.

When the inner portion is surrounded and encased by the outer portion, the core material in the inner portion of the article and matrix material in the outer portion of the article are selected such that the core material has a higher corrosion rate than the matrix material when tested under the same conditions.

The outer portion of the articles can comprise a network formed by an energetic material in the form of continuous fibers, wires, or foils, or a combination comprising at least one of the foregoing, and a matrix material distributed throughout the network of the energetic material. The outer portion of the downhole articles can also contain an energetic material randomly distributed in a matrix material in the form of particles, pellets, short fibers, or a combination comprising at least one of the foregoing. In an embodiment, the outer portion has a layered structure including matrix layers and energetic material layers. An exemplary layered structure has alternating layers of a matrix material and an energetic material. The arrangement allows for selective removal of a portion of the downhole article upon selective activation of one or more layers of the energetic material.

Once the energetic material in the outer portion of the article is activated, the outer portion disintegrates exposing the inner portion of the article. Since the inner portion of the article has an aggressive corrosion rate in a downhole fluid, the inner portion of the article can rapidly disintegrate once exposed to a downhole fluid.

The matrix material comprises a polymer, a metal, a composite, or a combination comprising at least one of the foregoing, which provides the general material properties such as strength, ductility, hardness, density for tool functions. As used herein, a metal includes metal alloys. The matrix material can be corrodible or non-corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing. The disintegration of the articles can be achieved through chemical reactions, thermal cracking, mechanical fracturing, or a combination comprising at least one of the foregoing. When the matrix material is not corrodible, the downhole article can be disintegrated by physical forces generated by the energetic material upon activation. When the matrix material is corrodible, the downhole article can be disintegrated by chemical means via the corrosion of the matrix material in a downhole fluid. The heat generated by the energetic material can also accelerate the corrosion of the matrix material. Both chemical means and physical means can be used to disintegrate downhole articles that have corrodible matrix materials.

In an embodiment, the corrodible matrix material comprises Zn, Mg, Al, Mn, an alloy thereof, or a combination comprising at least one of the foregoing. The corrodible matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

It will be understood that corrodible matrix materials will have any corrosion rate necessary to achieve the desired performance of the downhole article once the article completes its function. In a specific embodiment, the corrodible matrix material has a corrosion rate of about 0.1 to about 450 $mg/cm^2$/hour, specifically about 1 to about 450 $mg/cm^2$/hour determined in aqueous 3 wt. % KCl solution at 200° F. (93° C.).

In an embodiment, the matrix formed from the matrix material (also referred to as corrodible matrix) has a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the nanomatrix material.

The matrix can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the downhole article. The CEM materials including the composites formed therefrom have been described in U.S. Pat. Nos. 8,528,633 and 9,101,978.

The matrix material can be disintegrable polymers and their composites including poly(lactic acid) (PLA), poly (glycolic acid) (PGA), polycaprolactone (PCL), polylactide-co-glycolide, polyurethane such as polyurethane having ester or ether linkages, polyvinyl acetate, polyesters, and the like.

Optionally, the matrix material further comprises additives such as carbides, nitrides, oxides, precipitates, dispersoids, glasses, carbons, or the like in order to control the mechanical strength and density of the downhole article.

The energetic material comprises a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitates the rapid disintegration of the downhole articles.

Thermite compositions include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

As used herein, energetic polymers are materials possessing reactive groups, which are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the dissipation of the energy generated by the decomposition of the active groups. The heat and gas released promote the disintegration of the downhole articles.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The reactive multi-layer foil comprises aluminum layers and nickel layers or the reactive multi-layer foil comprises titanium layers and boron carbide layers. In specific embodiments, the reactive multi-layer foil includes alternating aluminum and nickel layers.

The amount of the energetic material is not particularly limited and is generally in an amount sufficient to generate enough energy to facilitate the rapid disintegration of the downhole articles once the energetic material is activated. In one embodiment, the energetic material is present in an amount of about 0.5 wt. % to about 45 wt. % or about 0.5 wt. % to about 20 wt. % based on the total weight of the downhole articles.

The downhole articles also include a sensor, which is operative to receive and process a signal to activate an energetic material, to determine a parameter change to trigger the activation of an energetic material, or to monitor a parameter of the downhole article, a downhole assembly comprising the downhole article, a well condition, or a combination comprising at least one of the foregoing. The parameter includes the disintegration status of the downhole article, the position of the downhole article, the position of the downhole assembly, pressure or temperature of the downhole environment, downhole fluid type, flow rate of produced water, or a combination comprising at least one of the foregoing. The sensor comprises a sensor material, a sensor element, or a combination comprising at least one of the foregoing. A downhole article can include more than one sensor, where each sensor can have the same or different functions.

To receive and process a signal to activate an energetic material, the sensor can include a receiver to receive a disintegration signal, and a triggering component that is effective to generate an electric current. Illustrative triggering component includes batteries or other electronic components. Once a disintegration signal is received, the triggering component generates an electric current and triggers the activation of the energetic material. The disintegration signal can be obtained from the surface of a wellbore or from a signal source in the well, for example, from a signal source in the well close to the downhole article.

In some embodiments, no external signal source is needed. The sensor can detect a parameter of interest such as a pressure, stress, or mechanical force applied to the disintegrable. Once the detected value exceeds a predetermined threshold value, the sensor generates an electrical signal which triggers the activation of the energetic material. Illustratively, a piezoelectric material can be used as the sensor material. The piezoelectric material detects a pressure such as hydraulic pressure, stress, or mechanical force applied to the downhole article. In the event that the detected pressure, stress, or mechanical force is greater than a predetermined value, the piezoelectric material generates an electrical charge to activate the energetic material.

The disintegrable sensor can also be configured to determine the disintegration status of the downhole article. For example, sensors with different tracer materials can be placed at different locations of the downhole article. The disintegration of the downhole article releases the tracer materials. Depending on the type of tracer materials detected, real time disintegration status can be determined. Alternatively or in addition, in the event that the matrix material releases a detectable chemical upon corrosion, the detectable chemical can also be used to provide disintegration information of the downhole article.

In some embodiments, the sensor includes chemical sensors configured for elemental analysis of conditions (e.g., fluids) within the wellbore. For example, the sensor can include carbon nanotubes (CNT), complementary metal oxide semiconductor (CMOS) sensors configured to detect the presence of various trace elements based on the principle of a selectively gated field effect transistors (FET) or ion sensitive field effect transistors (ISFET) for pH, $H_2S$ and other ions, sensors configured for hydrocarbon analysis, CNT, DLC based sensors that operate with chemical electropotential, and sensors configured for carbon/oxygen analysis. Some embodiments of the sensor may include a small source of a radioactive material and at least one of a gamma ray sensor or a neutron sensor.

The sensor can include other sensors such as pressure sensors, temperature sensors, stress sensors and/or strain sensors. For example, pressure sensors may include quartz crystals. Piezoelectric materials may be used for pressure sensors. Temperature sensors may include electrodes configured to perform resistivity and capacitive measurements that may be converted to other useful data. Temperature sensors can also comprise a thermistor sensor including a thermistor material that changes resistivity in response to a change in temperature.

In some embodiments, the sensor includes a tracer material such as an inorganic cation; an inorganic anion; an isotope; an activatable element; or an organic compound. Exemplary tracers include those described in US 20160209391. The tracer material can be released from the downhole articles while the articles disintegrate. The concentration of the release tracer material can be measured thus providing information such as concentration of water or flow rate of produced water.

The sensor may couple with a data processing unit. Such data processing unit includes electronics for obtaining and processing data of interest. The data processing unit can be located downhole or on the surface.

The microstructures of the exemplary downhole articles according to various embodiments of the disclosure are illustrated in FIGS. 1-4. Referring to FIG. 1, the downhole article 20 includes matrix 22, energetic material 24, and sensors 26. The energetic material forms an interconnected network. The sensors are randomly or purposely positioned in the downhole article.

Figure 2:
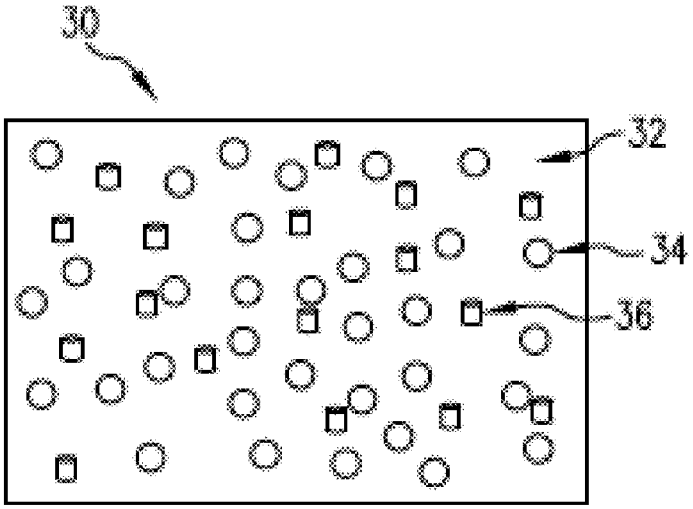
FIG. 2 is a schematic diagram of an exemplary downhole article that includes a matrix material, an energetic material, and a sensor, wherein the energetic material is randomly distributed in the matrix material.

The downhole article 30 illustrated in FIG. 2 includes matrix 32, energetic material 34, and sensors 36, where the energetic material 34 is randomly dispersed within matrix 32 as particles, pellets, short fibers, or a combination comprising at least one of the foregoing.

Figure 3:
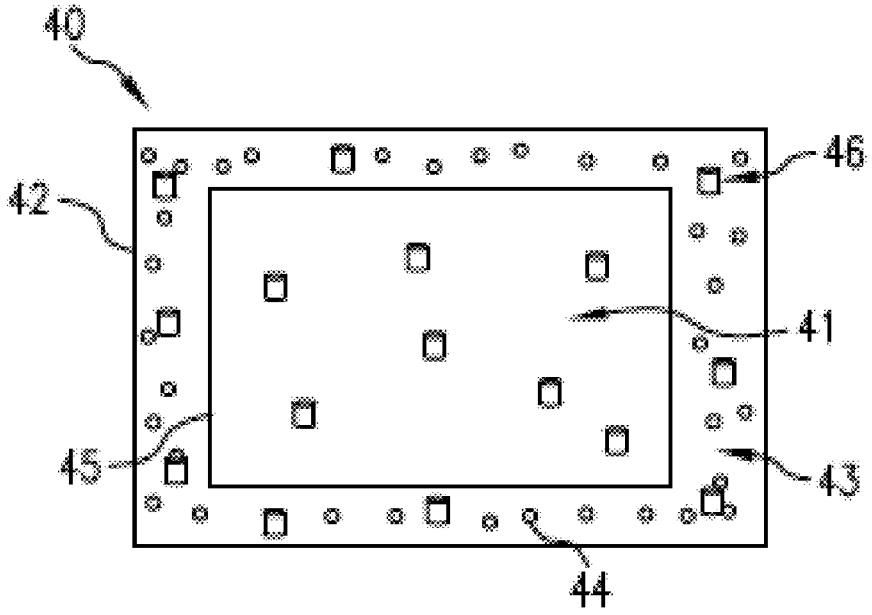
FIG. 3 is a schematic diagram of an exemplary downhole article that includes an inner portion and an outer portion disposed of the inner portion, the inner portion comprising a disintegrable material, and the outer portion comprising a matrix material and an energetic material.

The downhole article 40 illustrated in FIG. 3 includes an inner portion 45 and an outer portion 42, wherein the inner portion 45 contains a core material 41 and the outer portion 42 contains an energetic material 44 and matrix 43. Sensors 46 can be positioned in the inner portion 45, in the outer portion 42, or both. Although in FIG. 3, it is shown that the energetic material 44 is randomly distributed in the matrix 43 in the outer portion 42 of the downhole article 40, it is appreciated that the outer portion 42 can also have a structure as shown in FIG. 1 for article 20.

Figure 4:
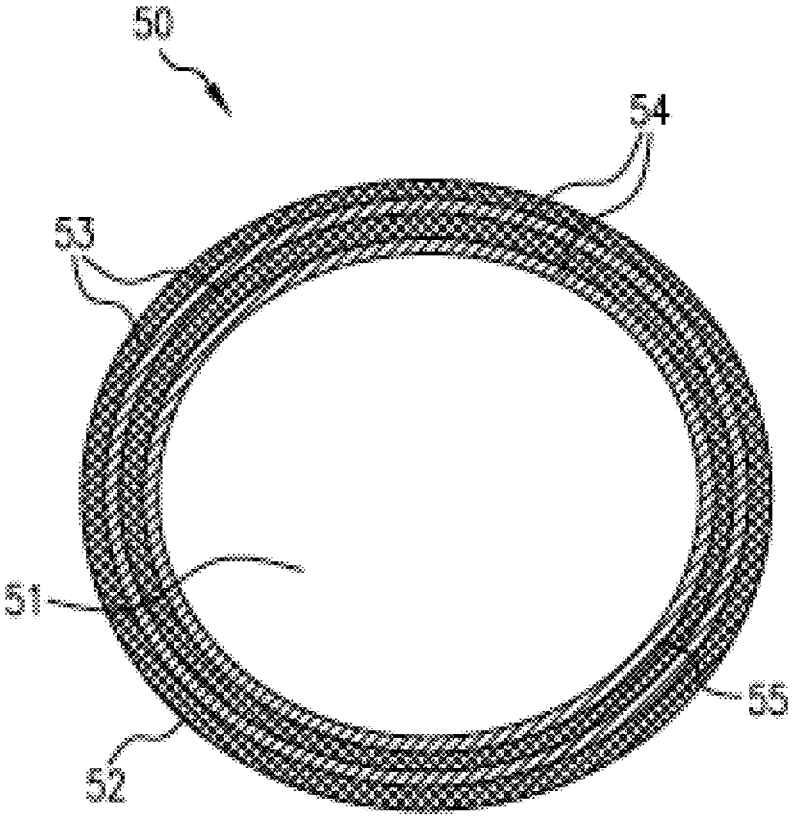
FIG. 4 is a schematic diagram of another exemplary downhole article that includes an inner portion and an outer portion disposed of the inner portion, wherein the outer portion includes a layered structure.

The downhole article 50 illustrated in FIG. 4 includes an inner portion 55 and an outer portion 52, wherein the inner portion 55 contains a core material 51 and the outer portion 52 has a layered structure that contains matrix layers 53 and energetic material layers 54. Sensors (not shown) can be disposed in the inner portion, the outer portion, or both.

Downhole articles in the downhole assembly are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the downhole article is a ball, a fracture plug, a whipstock, a cylinder, or a liner plug. A downhole assembly comprising the downhole article is also provided.

The downhole articles disclosed herein can be controllably removed such that significant disintegration only occurs after these articles have completed their functions. A method of controllably removing a downhole article comprises disposing a downhole article comprising a matrix material, an energetic material, and a sensor in a downhole environment; performing a downhole operation; activating the energetic material; and disintegrating the downhole article.

The method further comprises determining a parameter of the downhole article, a downhole assembly comprising the downhole article, the downhole environment, or a combination comprising at least one of the foregoing. The parameter comprises disintegration status of the downhole article, the position of the downhole article, position of the downhole assembly, pressure or temperature of the downhole environment, flow rate of produced water, or a combination comprising at least one of the foregoing.

The methods allow for a full control of the disintegration profile. The downhole articles can retain their physical properties until a signal or activation command is produced. Because the start of the disintegration process can be controlled, the downhole articles can be designed with an aggressive corrosion rate in order to accelerate the disintegration process once the articles are no longer needed.

The downhole article or a downhole assembly comprising the same can perform various downhole operations while the disintegration of the article is minimized. The downhole operation is not particularly limited and can be any operation that is performed during drilling, stimulation, completion, production, or remediation.

Once the downhole article is no longer needed, the disintegration of the article is activated. The method can further comprise receiving an instruction or signal from above the ground or generating an instruction or signal downhole to activate the energetic material. Activating the energetic material comprises providing a command signal to the downhole article, the command signal comprising electric current, electromagnetic radiation such as microwaves, laser beam, mud pulse, hydraulic pressure, mechanical fore, or a combination comprising at least one of the foregoing. The command signal can be provided above the surface or generated downhole. In an embodiment, activating the energetic material comprises detecting a pressure, stress, or mechanical force applied to the downhole article to generate a detected value; comparing the detected value with a threshold value; and generating an electrical change to activate the energetic material when the detected value exceeds the threshold value. In another embodiment, activating the energetic material includes receiving a command signal by the sensor, and generating an electric current by the sensor to activate the energetic material. Activating the energetic material can further comprise initiating a reaction of the energetic material to generate heat.

Figure 5:
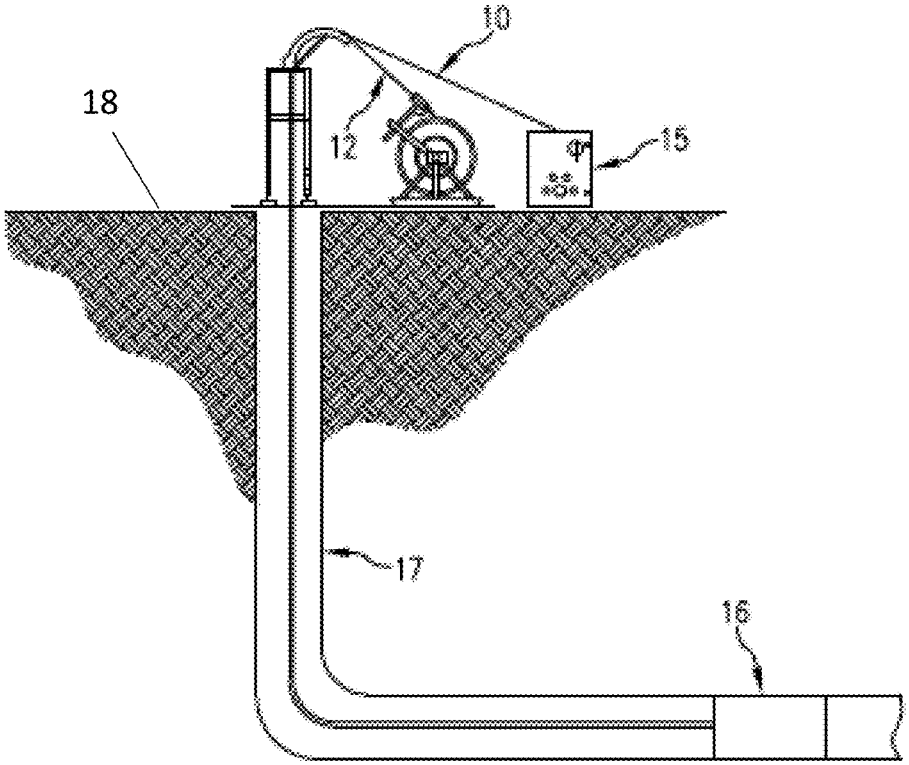
FIG. 5 is a schematic diagram illustrating a downhole assembly disposed in a downhole environment according to an embodiment of the disclosure.

Referring to FIG. 5, a downhole assembly 16 is disposed in borehole 17 via a coil tubing or wireline 12. A communication line 10 couples the downhole assembly to a processor 15. The communication line 10 can provide a command signal such as a selected form of energy from processor 15 to the downhole assembly 16 to activate the energetic material in the downhole assembly 16. The communication line 10 can also process the data generated by the sensor in the downhole article to monitor the disintegration status of the downhole assembly 16, position of the downhole assembly and the well conditions. The communication line 10 can be optical fibers, electric cables or the like, and it can be placed inside of the coil tubing or wireline 12.

Figure 6A:
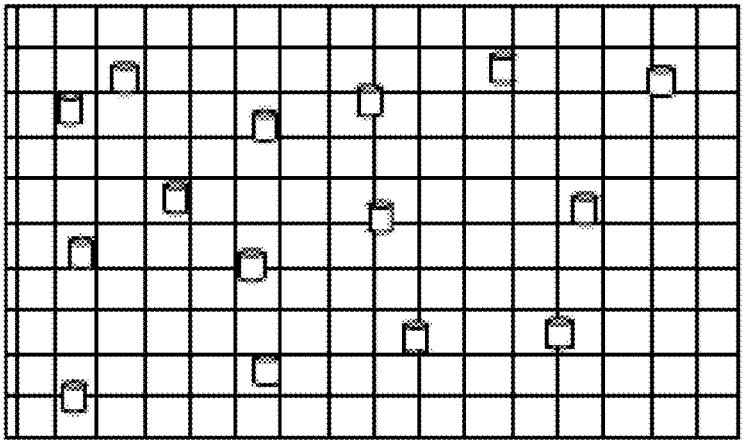
FIGS. 6A-6F illustrate a process of disintegrating a downhole article according to an embodiment of the disclosure, where
Figure 6B:
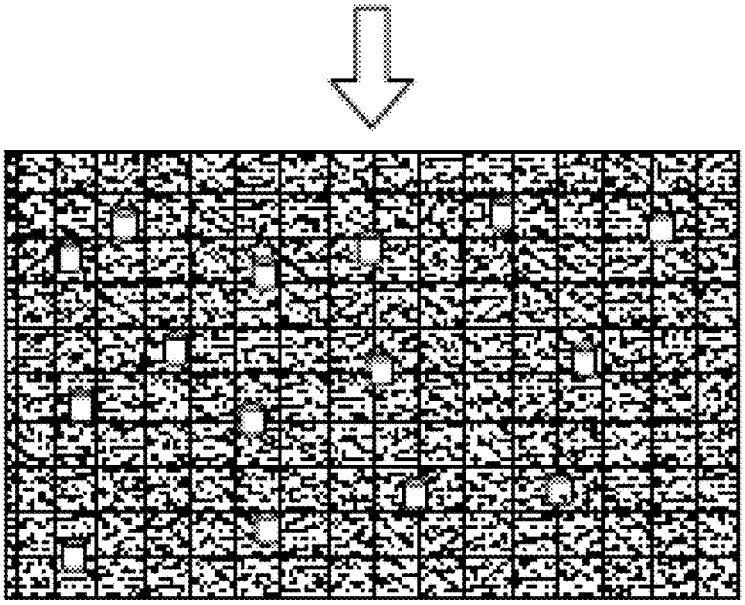
Figure 6C:
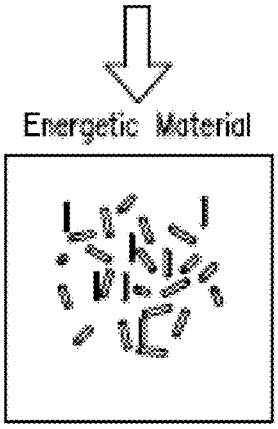
Figure 6D:
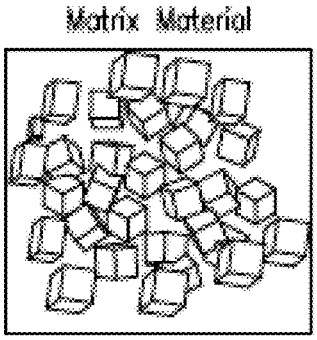
Figure 6E:
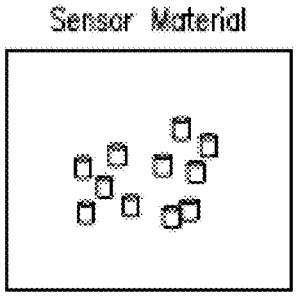
Figure 6F:
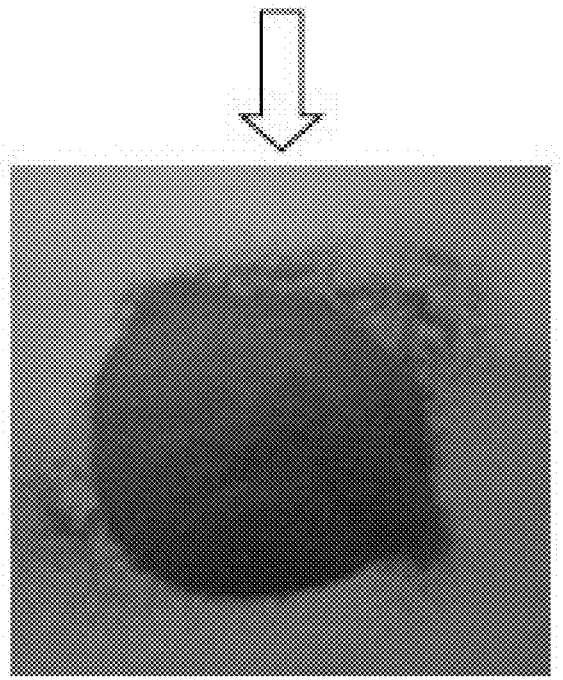

Referring to FIGS. 6A-6E, before activation, a downhole article as shown in FIG. 6A contains an energetic material network, a matrix, and sensors. After activation, heat is generated, and the disintegration article as shown in FIG. 6B breaks into small pieces, such as an energetic material, a matrix material, and a sensor material as shown in FIGS. 6C, 6D, and 6E respectively. In an embodiment, the small pieces can further corrode in a downhole fluid forming powder particles as shown in FIG. 6F. The powder particles can flow back to the surface thus conveniently removed from the wellbore.

Figure 7A:
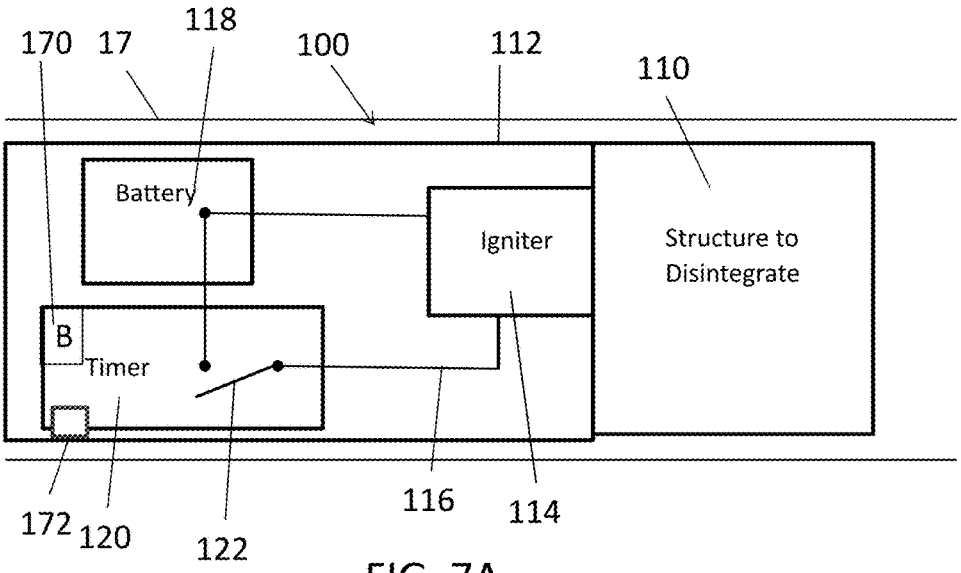
FIGS. 7A and 7B schematically illustrate an embodiment of a downhole assembly having a triggering system, where
Figure 7B:
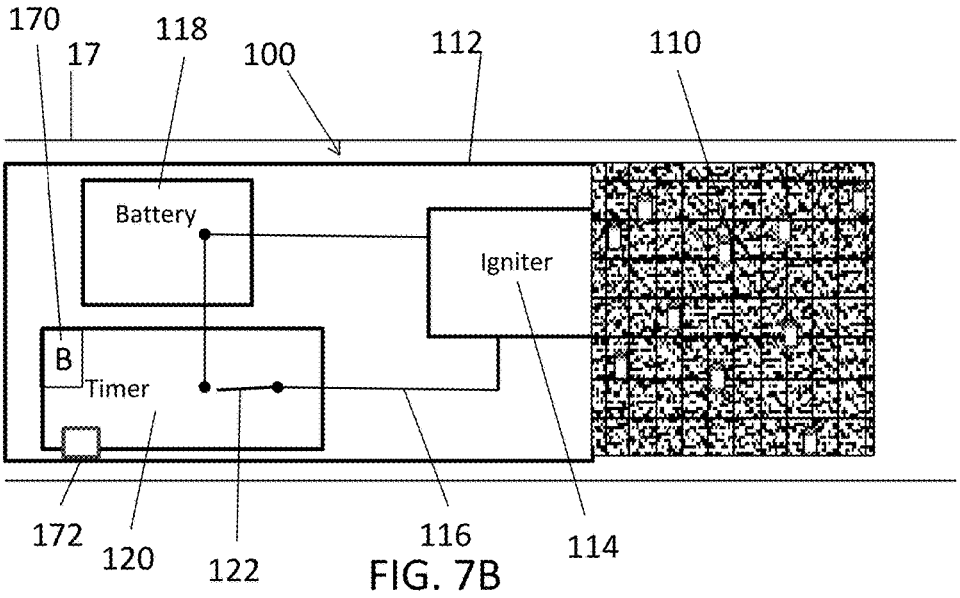

FIGS. 7A-7B illustrate an embodiment of a downhole assembly 100 that includes a degradable downhole tool 110, including both partially and completely disintegrable downhole tools, as well as a triggering system 112 for the initiation of the ignition of the degradation of the tool 110. The downhole tool 110 incorporates any of the above-described arrangements of a downhole article in at least a portion of the downhole tool 110. That is, the downhole tool is at least partially formed from a degradable material including the above-described energetic material having the structural properties. The degradable material is a degradable-on-demand material that does not begin degradation until a desired time that is chosen by an operator (as opposed to a material that begins degradation due to conditions within the borehole 17), thus the degradation is controllable, and may further be exceedingly more time efficient than waiting for the material to degrade from borehole conditions. The energetic material can be in the form of continuous fibers, wires, foils, particles, pellets, short fibers, or a combination comprising at least one of the foregoing. In the degradable-on-demand portion of the downhole tool 110, the energetic material is interconnected in such a way that once a reaction of the energetic material is initiated at one or more starting locations or points, the reaction can self-propagate through the energetic material in the degradable-on-demand components. As used herein, interconnected or interconnection is not limited to physical interconnection. Also, the degradable-on-demand material may further include the above-noted matrix material, and may further include the sensor. In some embodiments, the downhole tool 110 may be entirely composed of a downhole article, whereas in other embodiments only certain parts of the downhole tool 110 are composed of a downhole article. The downhole assembly 100, including both the downhole tool 110 having the downhole article and the triggering system 112, may be packaged in a single, self-contained unit that can be run downhole so that the article 110 can serve a downhole function prior to disintegration. That is, the triggering system 112 may be directly attached to, embedded within, or otherwise incorporated into the downhole tool 110. The schematic view of the triggering system 112 is exaggerated for clarity, and may be of various sizes and locations with respect to the downhole tool 110. For example, if the downhole tool 110 is, for example, a sleeve or frac plug, which is designed to allow flow through the borehole 17 in one or both downhole and uphole directions, then the triggering system 112 would be arranged so as to not block a flowbore of the tool 110.

The triggering system 112 includes an igniter 114 arranged to directly ignite the tool 110, or at least to directly ignite the downhole article within the downhole tool 110 if the downhole tool 110 is not made entirely of the degradable-on-demand material. In particular, the igniter 114 may be arranged to directly engage with and ignite at least one starting point of the energetic material. In the illustrated embodiment, the triggering system 112 further includes an electrical circuit 116. In FIG. 7A, the circuit 116 is open so that the igniter 114 is not activated, not provided with electric current, and thus does not ignite the article 110. In FIG. 7B, the circuit 116 is closed so that battery 118 starts to provide electric current to activate and set off the igniter 114, which initiates the disintegration of the degradable-on-demand material within the downhole tool 110 that the triggering system 112 is embedded in or otherwise attached to. Closure of the circuit 116 occurs when the switch 122 closes the circuit. In some embodiments, closing the switch 122 may be controlled by a timer 120, or as will be further described below, may be closed by movement of an object downhole. The object is exterior of and separate from the triggering system 112. In an embodiment including the timer 120, while the battery 118 could be separately connected to the timer 120 for operation of the timer 120, the timer 120 preferably includes its own separate battery 170 so that the battery 118 is dedicated to the igniter 114 to ensure sufficient energy release at the time of ignition. The timer 120 can be pre-set at surface 18 (see FIG. 5) or can be pre-set any time prior to running the downhole assembly 100 within the borehole 17. Having the timer 120 within the self-contained unit of the downhole tool 110 and triggering system 112 enables the unit to be independent of physical connections to surface 18 with respect to control of the triggering system 112. While the timer 120 can be set to close the switch 122 after any pre-selected time period, in one embodiment, the timer 120 remains inactive and does not start the time period until an object is moved within the borehole 17, as will be further described below. Once the timer 120 is initiated, such as by a physical engagement with a start switch 172 which will begin the timer 120, the time period commences. The time period may be set such that the switch 122 closes after the expected completion of a procedure in which the downhole tool 110 is utilized. In the embodiment where the timer 120 is inactive until a predetermined physical activity occurs within the borehole 17, the timer 120 is programmed to have a time period to close switch 122 from about the time the object is moved to the time the downhole tool 110 has completed a downhole procedure. Once the downhole tool 110 is no longer required, the circuit 116 can be closed in order to permit the battery 118 to provide electric current to set off the igniter 114. As demonstrated by FIG. 7B, once the circuit 116 is in the closed condition, and igniter 114 is activated, heat is generated, and the downhole article within the downhole tool 110 breaks into small pieces, such as an energetic material, a matrix material, and a sensor material. The degradation of the downhole tool 110 is controlled and gradual, as opposed to a rupture or detonation that may uncontrollably direct pieces of the degraded downhole tool 110 forcefully into other remaining downhole structures.

Figure 8:
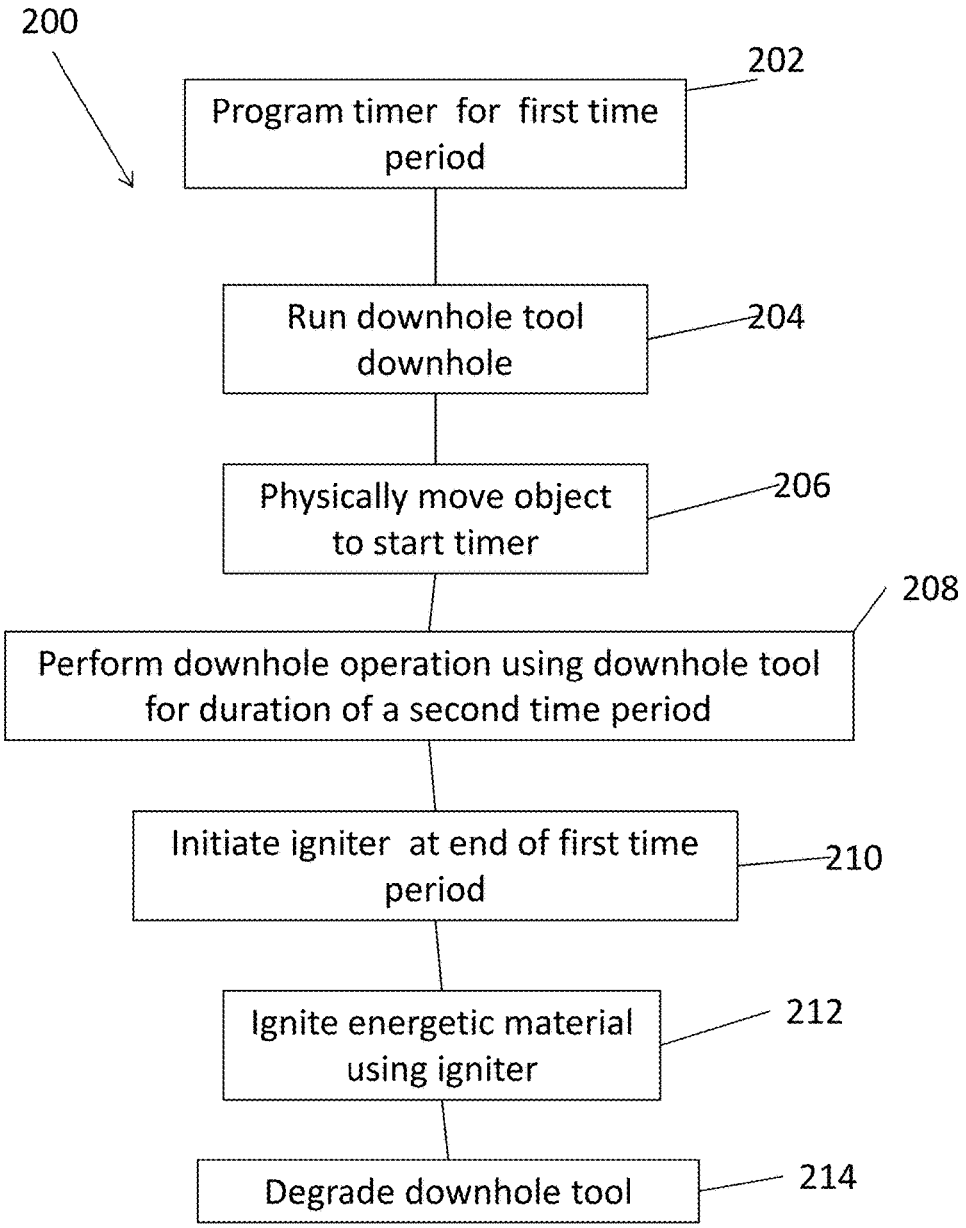
FIG. 8 is a flowchart of an embodiment of a method of degrading a downhole tool.

FIG. 8 is a flowchart of an embodiment of a method 200 of employing the triggering system 112 to degrade the downhole tool 110 of the downhole assembly 100. As indicated by box 202, in embodiments including the timer 120, the timer 120 is set by an operator or by a manufacturer, however the timer 120 remains inactive (the timer is not yet started) at this stage. As indicated by box 204, the downhole tool 110 is run downhole within borehole 17. The downhole tool 110 may be attached to any other equipment, tubing string, and other downhole tools that form the entirety of the downhole assembly 100. As indicated by box 206, a physical activity occurs within the borehole 17 that starts the timer 120. In particular, an object is moved that starts the timer 120. In one embodiment, the object may directly or indirectly engage with the start switch 172 of the timer 120 to start the timer 120. While the timer 120 is running (and while the electric circuit 116 remains open), a downhole operation using the downhole tool 110 is performed, as indicated by box 208. The utilization of the downhole tool 110 may occur for the duration of a second time period. At the conclusion of the first time period, the electrical circuit 116 is closed so that the igniter 114 is initiated, as indicated by box 210. The conclusion of the first time period may be after the conclusion of the second time period (after the end of the downhole operation). As indicated by box 212, once the igniter 114 is active, the energetic material is ignited and activated, which, as indicated by box 214, leads to degradation of the downhole tool 110.

Figure 9:
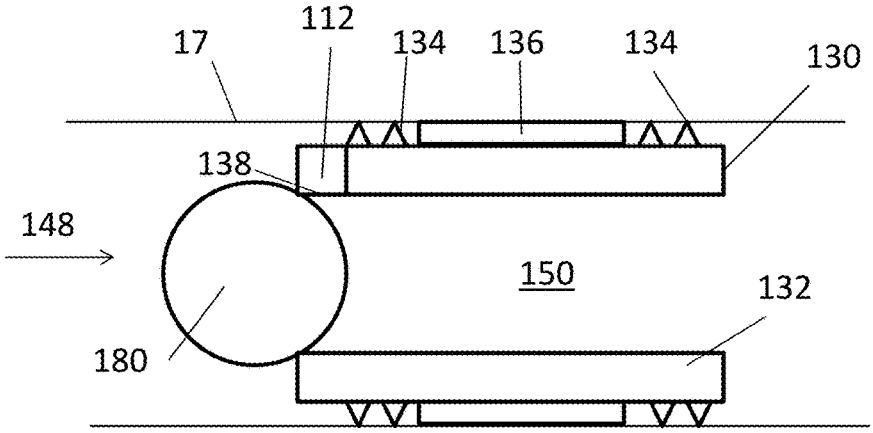
FIG. 9 schematically illustrates an embodiment of a frac plug as one embodiment of the downhole tool to degrade.

FIG. 9 illustrates one embodiment of a downhole tool 110 that may be utilized in the method 200. The downhole tool 110 is a frac plug 130. The frac plug 130 includes a body 132, slips 134, and a resilient member 136. The triggering system 112 is illustrated as disposed at an uphole end of the frac plug 130, such as at a ball seat 138 of the frac plug 130. The triggering system 112 may be attached to or embedded within the frac plug 130. At surface 18, the slips 134 and resilient member 136 have a first outer diameter which enables the frac plug 130 to be passed through the borehole 17. When the frac plug 130 reaches a desired location within the borehole 17, the frac plug 130 is set, such as by using a setting tool (not shown), to move the slips 134 radially outwardly to engage with an inner surface of the borehole 17 to prevent longitudinal movement of the frac plug 130 with respect to the borehole 17. At the same time, the resilient member 136 sealingly engages with the inner surface of borehole 17. In embodiments including the timer 120, the timer 120 in the triggering system 112 is inactive when the frac plug 130 is run downhole. To prevent flow through flowbore 150 in a downhole direction 148, so as to provide a pressure increase uphole of the frac plug 130, a frac ball 180 is landed on the frac plug 130. In particular, the frac ball 180 lands on seat 138. The landed frac ball 180 also engages with the triggering system 112, and the start switch 172 of the timer 120 is closed so that the timer 120 is started. When the frac plug 130 is no longer needed, such as after the completion of a plug and perf operation, the triggering system 112 ignites the frac plug 130 after the time period set within timer 120 ends, closes switch 122, and activates the igniter 114. Alternatively, when the triggering system 112 does not include the timer 120, the landed frac ball 180 engages with the triggering system 112 to close the switch 122, or otherwise close circuit 116 thus activating igniter 114 to ignite the frac plug 130 at least substantially immediately. In such an embodiment, the degradable-on-demand material would be designed to stay at least substantially intact until an end of the frac operation. That is, while the degradable-on-demand material may be ignited upon landing of the fracball 180, the degradation of the frac plug 130 would be slow enough to complete the frac operation before losing integrity of the frac plug 130.

Figure 10:
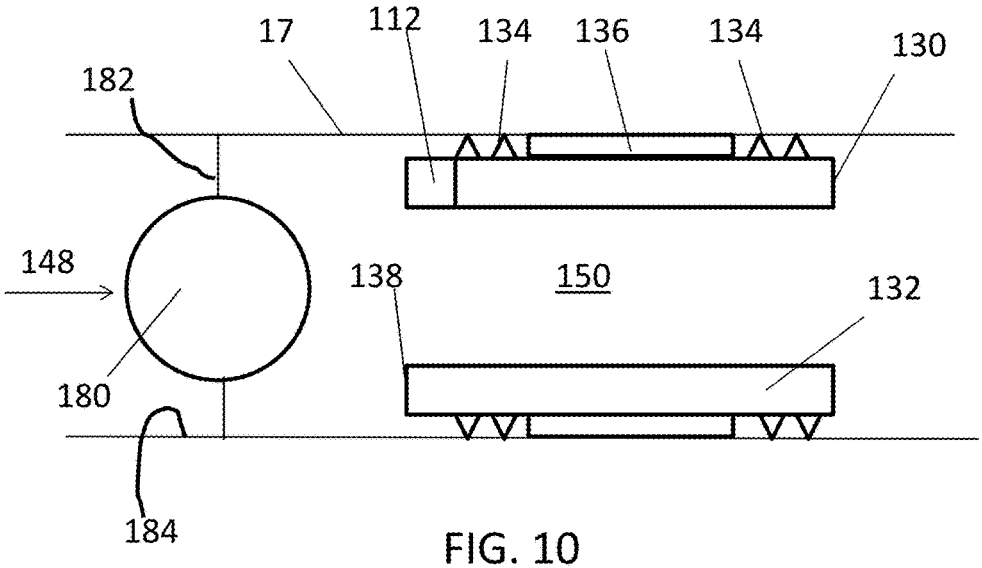
FIG. 10 schematically illustrates an embodiment of a frac plug as another embodiment of the downhole tool to degrade.

In one embodiment of FIG. 9, the timer 120 is started when the ball 180 lands on the frac plug 130. To ensure that the landing of the frac ball 180 successfully starts the timer 120, FIG. 10 illustrates an embodiment where the frac ball 180 is retained in the borehole 17 by one or more shear wires 182 that suspend the frac ball 180 within the borehole 17. The shear wires 182 may extend from the frac ball 180 to a liner or other tubular 184 that extends through the borehole 17. Alternatively, the frac plug 130 may include an extension (not shown) that supports the frac ball 180 uphole of the frac plug 130 using shear wires 182. In either embodiment, flow through the flowbore 150 is still enabled with the frac ball 180 retained in such a manner as the frac ball 180 and shear wires 182 do not entirely block fluid flow. The shear wires 182 can be configured to break and release the frac ball 180 at the beginning of a frac operation when frac pressure from frac fluids are directed forcefully in the downhole direction 148 towards the frac ball 180. With the frac ball 180 free from the connected shear wires 182, the frac ball 180 lands on the ball seat 138 and the timer 120 in the triggering system 112 is started. Degradation of the frac plug 130 may then occur subsequent the completion of the frac operation as in the previous embodiment. Alternatively, the landed frac ball 180 may close the switch 122 to begin degradation of the frac plug 130 as previously described with respect to an embodiment described with respect to FIG. 9.

Figure 11:
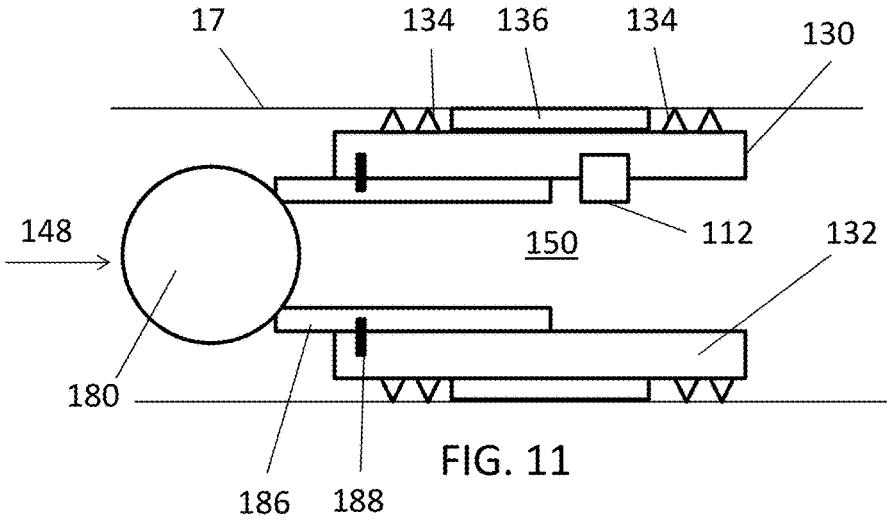
FIG. 11 schematically illustrates an embodiment of a frac plug as another embodiment of the downhole tool to degrade.

In the FIGS. 9 and 10 embodiments, the timer 120 in the triggering system 112 is started, or the switch 122 is immediately closed, due to the landing of the frac ball 180 on the frac plug 130. FIG. 11 illustrates another embodiment of a frac plug 130. In this embodiment, a sleeve 186 is shear pinned using pins 188 to the interior of the frac plug 130. An uphole end of the sleeve 186 receives the frac ball 180. When a predetermined pressure is reached, such as a frac pressure, the frac ball 180 forcibly moves the sleeve 186 in the downhole direction 148. Downhole movement of the sleeve 186 and frac ball 180 may be limited by a shoulder within the frac plug 130 that prevents downhole progress. Movement of the sleeve 186 starts the timer 120 in the triggering system 112, or alternatively closes the switch 122. In an embodiment using the timer 120, since the pressure to move the sleeve 186 is frac pressure, the time period programmed in the timer 120 may be set to be approximately longer than an expected frac operation. Degradation of the frac plug 130 may then occur subsequent the completion of the frac operation as in the previous embodiment. Both the frac plug 130 and the sleeve 186 may include degradable-on-demand materials.

Figure 12:
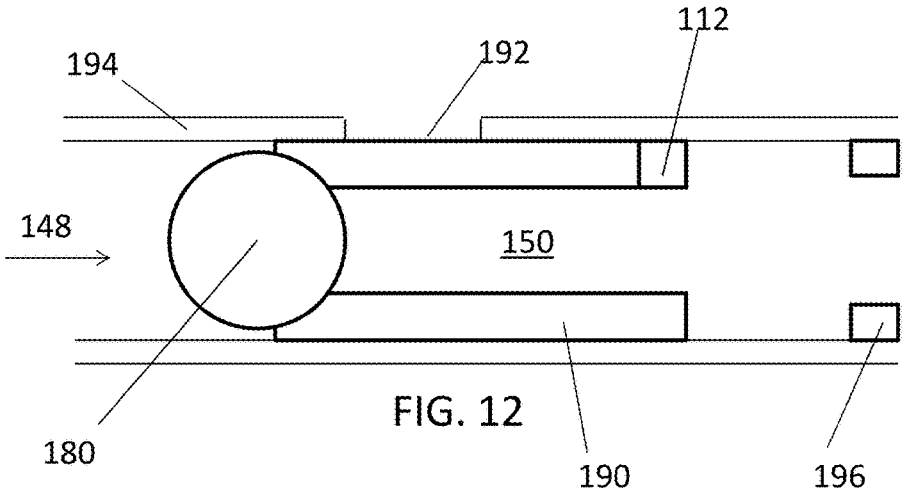
FIG. 12 schematically illustrates an embodiment of a slidable sleeve as another embodiment of the downhole tool to degrade.

While FIGS. 9-11 illustrate variations of a frac plug 130 as a downhole tool that can be degraded using the method 200 shown in FIG. 8, FIG. 12 shows an alternate downhole tool that can be employed in the method 200. Sliding sleeve 190 covers a port 192 in a tubular 194. The sliding sleeve 190 may be shifted in the downhole direction 148 after a frac ball 180 lands on an uphole end of the sliding sleeve 190 and frac pressure is applied in the tubular 194. Frac fluids can then exit the port 192. The shifting of the sleeve 190 abuts the triggering system 112 positioned at a downhole end of the sleeve 190 into a radially protruding shoulder 196 which starts the timer 120, or alternatively closes the switch 122 immediately. When the switch 122 is closed, either immediately or when the time period programmed in the timer 120 ends, the igniter 114 is activated to ignite the energetic material and degrade the matrix material of the sliding sleeve 190. Removal of the sliding sleeve 190 opens the flowbore 150 for greater production diameter.

Figure 13:
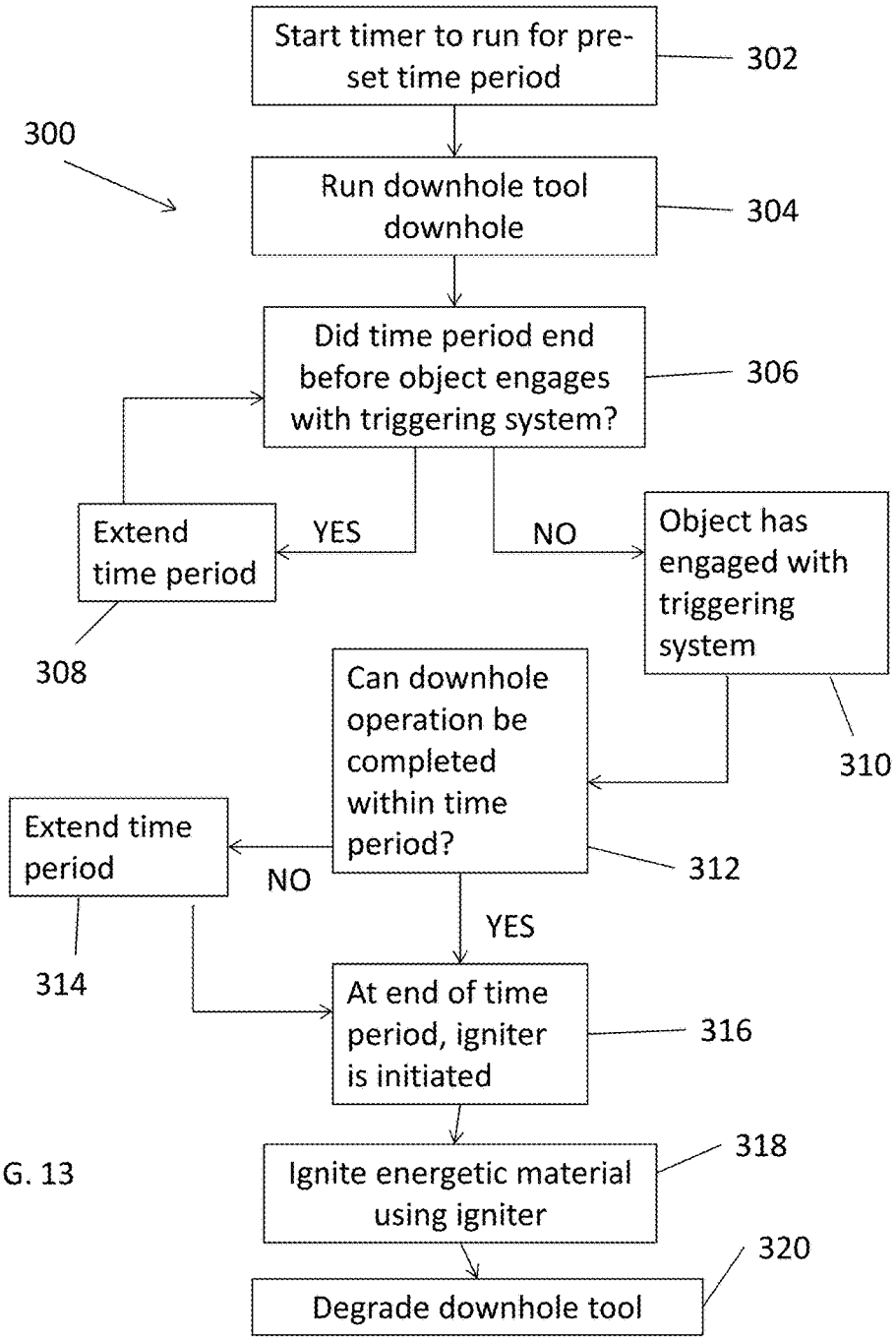
FIG. 13 is a flowchart of another embodiment of a method of degrading a downhole tool; and, FIG. 14 schematically illustrates an embodiment of a frac plug as another embodiment of the downhole tool to degrade.

FIG. 13 depicts a flowchart of a method of degrading the downhole tool in alternative embodiments. As indicated by box 302, the timer 120 is set at surface 18 or an alternative location with an initial preset value and started on surface, and then the downhole tool 110 is run downhole as indicated by box 304. In these embodiments, the triggering time (the time when the circuit 116 is closed) may be delayed or changed if an expected event does not happen by a certain time within the preset value, or does not happen at all. For example, if the timer 120 is set for 10 hours, but at the end of the 10 hours the ball 180 has still not landed on the frac plug 130, then a program will initiate to extend the time period. Thus, box 306 queries whether the time period has ended before the object has engaged with the triggering system 112, and box 308 indicates that the time period is extended when the time period has ended before the object engages with the triggering system 112. At the end of the extended time period, if the moving object event still has not occurred, then the program will repeat to extend the time period, and will continually repeat as long as the moving object event has not occurred. If the object has engaged with the triggering system, as indicated by box 310, then box 312 queries whether or not the downhole operation can be completed within the time period. For example, if the ball 180 lands at 9 hours into a 10 hour time period, and a frac operation is expected to take longer than one hour, then the time period for closing the circuit 116 is extended, as indicated by box 314, since it may be undesirable to initiate degradation of the downhole tool 110 prior to completion of the downhole procedure. The extension of the time period can be calculated within a controller within the timer 120, taking into account whether or not the moving object event has occurred (box 306), and if it has, at what time within the original time period (box 312). In such embodiments, instead of the moving object (such as, but not limited to, frac ball 180, sleeve 186, and sleeve 190) serving to start the timer 120 in the triggering mechanism 112, the moving object engages with the triggering system 112 to initiate a computer program that determines whether the igniter 114 can be activated at the end of the time period or whether an extension should be calculated. Once it has been deemed that the downhole operation can be completed within the time period, then at the end of the time period, as indicated by box 316, the igniter 114 will be initiated and the energetic material will be ignited, as indicated by box 318, to degrade the downhole tool 110, as indicated by box 320.

Figure 14:
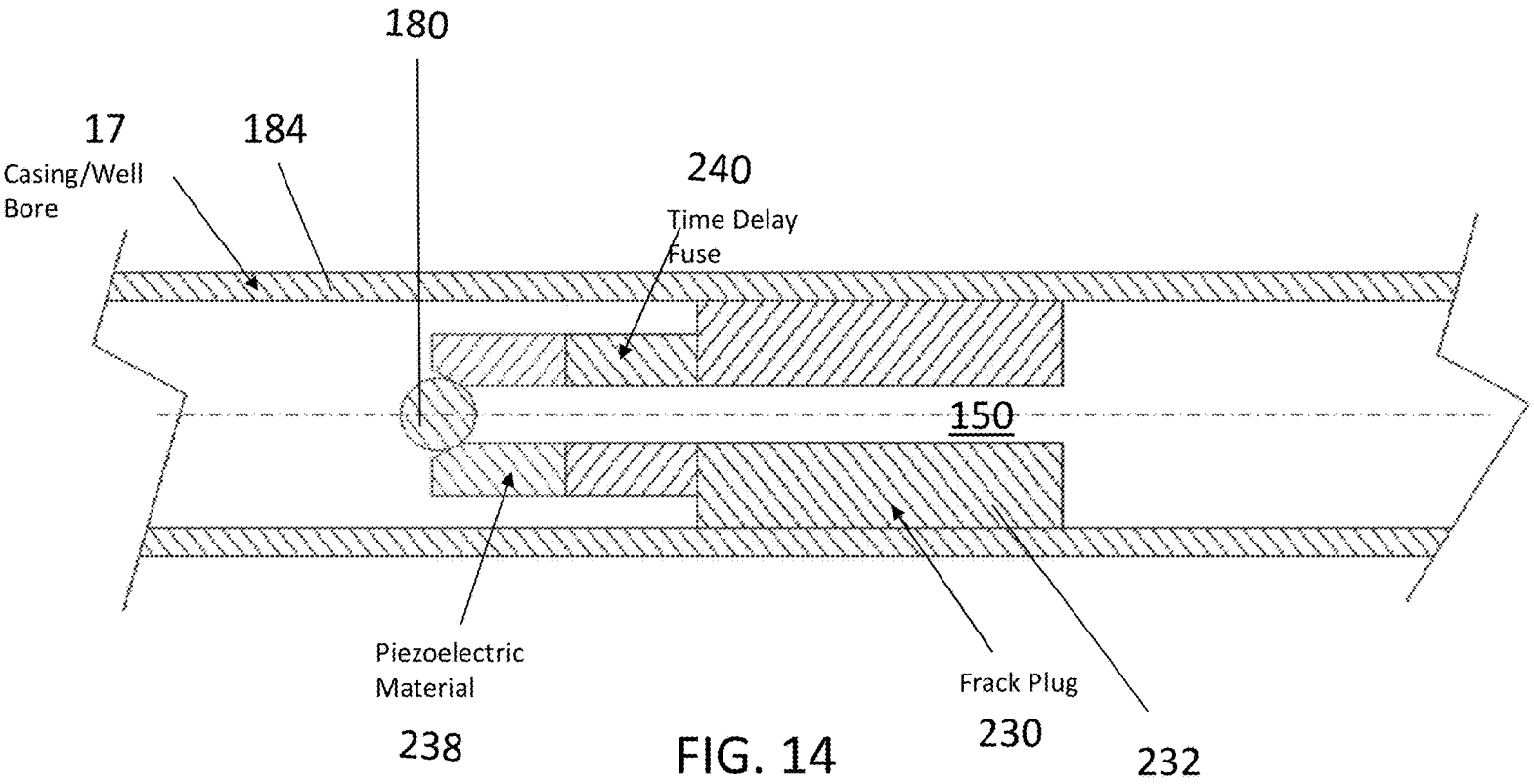

With reference now to FIG. 14, another embodiment of a degradable frac plug 230 is shown. The frac plug 230 includes a body 232 made of the degradable-on-demand material including at least the matrix material and the energetic material. Although not shown in FIG. 14, the frac plug 230 may include slips and a resilient member as shown in FIGS. 9-11. To initiate ignition and activation of the energetic material in the frac plug 230, a frac ball 180 is landed on a ball seat 238 formed of a piezoelectric material. When pressure in the borehole 17 is increased, such as to frac pressure, the piezoelectric material of the ball seat 238 is ruptured and creates a spark which ignites the time delay fuse 240. Both the ball seat 238 and the time delay fuse 240 share the flowbore 150 with the body 232 of the frac plug 230. Since the frac plug 230 is needed for the duration of a frac operation, the time delay fuse 240 is provided with the dimensions and slow-burning materials necessary to delay ignition of the energetic material within the frac plug 230 for a predetermined amount of time. By example only, the time delay fuse 240 may take approximately five hours to burn prior to igniting the frac plug 130. Thus, the time delay fuse 240 operates as a timer in this embodiment, where the timer is activated to start upon movement of a downhole object, in this case the frac ball 180. When the frac plug 230 is finally ignited, the frac operation is already completed and the frac plug 230 is degraded.

In one embodiment, only select portions of the frac plug 130, 230 are formed of the above-described degradable-on-demand material, such as, but not limited to the body 132. In another embodiment, other portions of the frac plug 130 are not formed of the degradable-on-demand material, however, such other portions may be formed of a different degradable material, such as but not limited to the matrix material that does not include the energetic material, that can be effectively and easily removed once the degradable article made of the degradable-on-demand material of the frac plug 130, 230 has been degraded or during the degradation of the degradable article within the frac plug 130, 230. When only one part of the frac plug 130, 230 is made of degradable-on-demand material, such as, but not limited to the body 132 or cone (such as a frustoconical element), the degradation of that part may eliminate the support to the other components, such as, but not limited to, the slip 134. In this way, the frac plug 130, 230 can collapse off from the casing to remove obstacle to flow path on-demand; in addition, degradable-on-demand material generates heat which can speed up the degradations of the rest of the frac plug 130, 230.

Various embodiments of the disclosure include a downhole assembly having a downhole article that includes a matrix material; an energetic material configured to generate energy upon activation to facilitate the disintegration of the downhole article; and a sensor. In any prior embodiment or combination of embodiments, the sensor is operative to receive and process a signal to activate the energetic material, to determine a parameter change to trigger the activation of the energetic material, to monitor a parameter of the downhole article, the downhole assembly, a well condition, or a combination comprising at least one of the foregoing. In any prior embodiment or combination of embodiments, the sensor is configured to monitor the disintegration status of the downhole article. In any prior embodiment or combination of embodiments, the energetic material includes interconnected continuous fibers, wires, foils, or a combination comprising at least one of the foregoing. In any prior embodiment or combination of embodiments, the energetic material includes continuous fibers, wires, or foils, or a combination comprising at least one of the foregoing, which form a three dimensional network; and the matrix material is distributed throughout the three dimensional network. In any prior embodiment or combination of embodiments, the energetic material is randomly distributed in the matrix material in the form of particles, pellets, short fibers, or a combination comprising at least one of the foregoing. In any prior embodiment or combination of embodiments, the downhole article includes an inner portion and an outer portion disposed of the inner portion, the inner portion comprising a core material that is corrodible in a downhole fluid; and the outer portion comprising the matrix material and the energetic material. In any prior embodiment or combination of embodiments, the downhole article includes an inner portion and an outer portion disposed of the inner portion, the inner portion including a core material that is corrodible in a downhole fluid; and the outer portion having a layered structure comprising one or more energetic material layers and one or more matrix material layers. In any prior embodiment or combination of embodiments, the sensor is disposed in the inner portion of the downhole article, the outer portion of the downhole article, or both. In any prior embodiment or combination of embodiments, the core material and the matrix material are selected such that the core material has a higher corrosion rate than the matrix material when tested under the same conditions. In any prior embodiment or combination of embodiments, the inner portion is encased within the outer portion. In an embodiment, the matrix material includes one or more of the following: a polymer; a metal; or a composite. In any prior embodiment or combination of embodiments, the matrix material is not corrodible in a downhole fluid. In any prior embodiment or combination of embodiments, the matrix material is corrodible in a downhole fluid. In any prior embodiment or combination of embodiments, the matrix material includes Zn, Mg, Al, Mn, an alloy thereof, or a combination comprising at least one of the foregoing. In any prior embodiment or combination of embodiments, the matrix material further includes Ni, W, Mo, Cu, Fe, Cr, Co, an alloy thereof, or a combination comprising at least one of the foregoing. In any prior embodiment or combination of embodiments, the energetic material includes a thermite, a reactive multi-layer foil, an energetic polymer, or a combination comprising at least one of the foregoing. In any prior embodiment or combination of embodiments, the thermite includes a reducing agent including aluminum, magnesium, calcium, titanium, zinc, silicon, boron, and a combination comprising at least one of the foregoing reducing agent, and an oxidizing agent comprising boron oxide, silicon oxide, chromium oxide, manganese oxide, iron oxide, copper oxide, lead oxide, and a combination comprising at least one of the foregoing oxidizing agent. In any prior embodiment or combination of embodiments, the energetic polymer includes a polymer with azide, nitro, nitrate, nitroso, nitramine, oxetane, triazole, tetrazole containing groups, or a combination comprising at least one of the foregoing. In any prior embodiment or combination of embodiments, the reactive multi-layer foil comprises aluminum layers and nickel layers or the reactive multi-layer foil comprises titanium layers and boron carbide layers. In any prior embodiment or combination of embodiments, the energetic material is present in an amount of about 0.5 wt. % to about 45 wt. % based on the total weight of the downhole article. In any prior embodiment or combination of embodiments, the sensor includes a sensor material, a sensor element, or a combination comprising at least one of the foregoing.

Various embodiments of the disclosure further include a method of controllably removing a disintegrable downhole article, the method including: disposing the downhole article in a downhole environment, the downhole article including a matrix material, an energetic material configured to generate energy upon activation to facilitate the disintegration of the downhole article, and a sensor; performing a downhole operation; activating the energetic material; and disintegrating the downhole article. In any prior embodiment or combination of embodiments, the method further includes determining a parameter of the downhole article, a downhole assembly comprising the downhole article, the downhole environment, or a combination comprising at least one of the foregoing. In any prior embodiment or combination of embodiments, the parameter includes disintegration status of the downhole article, position of the downhole article, position of the downhole assembly, pressure or temperature of the downhole environment, flow rate of produced water, or a combination comprising at least one of the foregoing. In any prior embodiment or combination of embodiments, activating the energetic material includes providing a command signal to the downhole article, the command signal comprising electric current, electromagnetic radiation, laser beam, mud pulse, hydraulic pressure, mechanical force, or a combination comprising at least one of the foregoing. In any prior embodiment or combination of embodiments, the method further includes detecting a pressure, stress, or mechanical force applied to the downhole article to generate a detected value; comparing the detected value with a threshold value; and generating an electrical charge to activate the energetic material once the detected value exceeds the threshold value. In any prior embodiment or combination of embodiments, activating the energetic material further includes initiating a reaction of the energetic material to generate heat.

Set forth below are various additional embodiments of the disclosure.

Embodiment 1

A downhole assembly includes a downhole tool including a degradable-on-demand material including: a matrix material; and, an energetic material configured to generate energy upon activation to facilitate the degradation of the downhole tool; and, a triggering system including: an electrical circuit having an open condition and a closed condition, the electrical circuit configured to be in the closed condition after movement of an object downhole that engages directly or indirectly with the triggering system; and, an igniter within the electrical circuit, the igniter arranged to ignite the downhole tool in the closed condition of the electrical circuit. In the open condition of the electrical circuit the igniter is inactive, and in the closed condition of the electrical circuit the igniter is activated.

Embodiment 2

The downhole assembly as in any prior embodiment or combination of embodiments, further including a switch in the triggering system, the switch arranged to close in response to movement of the object downhole.

Embodiment 3

The downhole assembly as in any prior embodiment or combination of embodiments, wherein closure of the switch closes the electrical circuit.

Embodiment 4

The downhole assembly as in any prior embodiment or combination of embodiments, further including a timer configured to be initiated in response to the movement of the object downhole, wherein the switch is a start switch of the timer, and the degradable-on-demand material is ignited by the igniter after a time period set by the timer ends.

Embodiment 5

The downhole assembly as in any prior embodiment or combination of embodiments, wherein the start switch is a first switch, and further comprising a second switch within the electrical circuit, the second switch configured to close the electrical circuit at the end of the time period set by the timer.

Embodiment 6

The downhole assembly as in any prior embodiment or combination of embodiments, wherein the downhole tool is a frac plug, the object includes a frac ball, and the switch is engaged by the frac ball when the frac ball lands on the frac plug.

Embodiment 7

The downhole assembly as in any prior embodiment or combination of embodiments, wherein the frac ball is tethered to a tubular uphole of the frac plug, and frac fluid pressure forces the frac ball onto the frac plug.

Embodiment 8

The downhole assembly as in any prior embodiment or combination of embodiments, wherein the object further includes a shifting sleeve shear pinned to the frac plug, and the shifting sleeve is sheared from the frac plug and moved to engage with the switch in response to frac fluid pressure that forces the shifting sleeve, with the frac ball seated thereon, to move downhole.

Embodiment 9

The downhole assembly as in any prior embodiment or combination of embodiments, wherein the downhole tool is a sliding sleeve and the object is a ball used to shift the sliding sleeve, and the switch is closed by sliding the sliding sleeve into a stationary shoulder.

Embodiment 10

The downhole assembly as in any prior embodiment or combination of embodiments, wherein the downhole tool is a frac plug, a first component of the frac plug is formed of the degradable-on-demand material, and a second component of the frac plug is formed of the matrix material, the second component not including the energetic material, and the second component in contact with the first component.

Embodiment 11

The downhole assembly as in any prior embodiment or combination of embodiments, wherein the electrical circuit further includes a battery, the battery arranged to provide electric current to set off the igniter in the closed condition of the electrical circuit.

Embodiment 12

The downhole assembly as in any prior embodiment or combination of embodiments, wherein the energetic material comprises continuous fibers, wires, or foils, or a combination comprising at least one of the foregoing, which form a three dimensional network; and the matrix material is distributed throughout the three dimensional network.

Embodiment 13

The downhole assembly as in any prior embodiment or combination of embodiments, wherein the matrix material has a cellular nanomatrix, a plurality of dispersed particles dispersed in the cellular nanomatrix, and a solid-state bond layer extending through the cellular nanomatrix between the dispersed particles.

Embodiment 14

The downhole assembly as in any prior embodiment or combination of embodiments, wherein the degradable-on-demand material further includes a sensor, the sensor operative to monitor a parameter of at least one of the degradable-on-demand material, the downhole tool, the downhole assembly, and a well condition.

Embodiment 15

A method of controllably removing the downhole tool of the downhole assembly as in any prior embodiment or combination of embodiments, the method including disposing the downhole assembly in a downhole environment; moving the object downhole to engage with the downhole tool and close a switch in the triggering system; performing a downhole operation using the downhole assembly; activating the energetic material using the igniter; and degrading the downhole tool.

Embodiment 16

The method as in any prior embodiment or combination of embodiments, wherein closing the switch starts a timer in the triggering system, and activating the energetic material using the igniter occurs at an end of a time period set in the timer.

Embodiment 17

The method as in any prior embodiment or combination of embodiments, wherein the degradable-on-demand material further includes a sensor, and further comprising determining a parameter of the downhole tool, the downhole assembly comprising the downhole tool, a downhole environment, or a combination comprising at least one of the foregoing using the sensor.

Embodiment 18

The method as in any prior embodiment or combination of embodiments, wherein moving the object downhole includes landing a frac ball on a frac plug.

Embodiment 19

The method as in any prior embodiment or combination of embodiments, wherein moving the object downhole includes landing a ball on a sleeve and shifting the sleeve.

Embodiment 20

A method of controllably removing a downhole tool of a downhole assembly, the method including: starting a timer in a triggering system of the downhole assembly for a pre-selected time period, the downhole tool including degradable-on-demand material having a matrix material and an energetic material configured to generate energy upon activation to facilitate degradation of the downhole tool; disposing the downhole assembly in a downhole environment; determining if a downhole operation can be completed within the pre-selected time period, and extending the pre-selected time period if the downhole operation cannot be completed within the pre-selected time period; performing the downhole operation using the downhole assembly; activating the energetic material at an end of the pre-selected time period or at an end of an extended time period using the igniter; and degrading the downhole tool.

Embodiment 21

The method as in any prior embodiment or combination of embodiments, prior to performing the downhole operation, determining, at the end of the pre-selected time period, if an object usable in the downhole operation has engaged with the triggering system, and extending the predetermined time period if the object has not engaged with the triggering system.

Embodiment 22

The method as in any prior embodiment or combination of embodiments, wherein the object is a ball and the downhole tool is one of a frac plug and a sliding sleeve.

Embodiment 23

A frac plug includes: a body formed of a degradable-on-demand material, the degradable-on-demand material including: a matrix material; and, an energetic material configured to generate energy upon activation to facilitate the degradation of the downhole tool; a time delay fuse in contact with an uphole end of the body and in contact with the energetic material; and, a ball seat including a piezoelectric material at an uphole end of the time delay fuse; wherein the piezoelectric material is configured to create a spark and ignite the time delay fuse after a ball is seated on the ball seat and pressure is increased on the ball in a downhole direction.

Embodiment 24

The frac plug as in any prior embodiment or combination of embodiments wherein the energetic material comprises continuous fibers, wires, or foils, or a combination comprising at least one of the foregoing, which form a three dimensional network; and the matrix material is distributed throughout the three dimensional network.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly comprising:

a downhole tool including a degradable-on-demand material, the degradable-on-demand material including:

a matrix material; and, an energetic material configured to generate energy upon activation to facilitate the degradation of the downhole tool; and, a triggering system including:

an electrical circuit having an open condition and a closed condition, the electrical circuit configured to be in the closed condition after movement of an object downhole that engages directly or indirectly with the triggering system; and, an igniter within the electrical circuit, the igniter arranged to ignite the downhole tool in the closed condition of the electrical circuit;

wherein, in the open condition of the electrical circuit the igniter is inactive, and in the closed condition of the electrical circuit the igniter is activated.

2. The downhole assembly of claim 1, further comprising a switch in the triggering system, the switch arranged to close in response to movement of the object downhole.

3. The downhole assembly of claim 2, wherein closure of the switch closes the electrical circuit.

4. The downhole assembly of claim 2, further comprising a timer configured to be initiated in response to the movement of the object downhole, wherein the switch is a start switch of the timer, and the degradable-on-demand material is ignited by the igniter after a time period set by the timer ends.

5. The downhole assembly of claim 4, wherein the start switch is a first switch, and further comprising a second switch within the electrical circuit, the second switch configured to close the electrical circuit at the end of the time period set by the timer.

6. The downhole assembly of claim 2, wherein the downhole tool is a frac plug, the object includes a frac ball, and the switch is engaged by the frac ball when the frac ball lands on the frac plug.

7. The downhole assembly of claim 6, wherein the frac ball is tethered to a tubular uphole of the frac plug, and frac fluid pressure forces the frac ball onto the frac plug.

8. The downhole assembly of claim 6, wherein the object further includes a shifting sleeve shear pinned to the frac plug, and the shifting sleeve is sheared from the frac plug and moved to engage with the switch in response to frac fluid pressure that forces the shifting sleeve, with the frac ball seated thereon, to move downhole.

9. The downhole assembly of claim 2, wherein the downhole tool is a sliding sleeve and the object is a ball used to shift the sliding sleeve, and the switch is closed by sliding the sliding sleeve into a stationary shoulder.

10. The downhole assembly of claim 1, wherein the downhole tool is a frac plug, a first component of the frac plug is formed of the degradable-on-demand material, and a second component of the frac plug is formed of the matrix material, the second component not including the energetic material, and the second component in contact with the first component.

11. The downhole assembly of claim 1, wherein the electrical circuit further includes a battery, the battery arranged to provide electric current to set off the igniter in the closed condition of the electrical circuit.

12. The downhole assembly of claim 1, wherein the energetic material comprises continuous fibers, wires, or foils, or a combination comprising at least one of the foregoing, which form a three dimensional network; and the matrix material is distributed throughout the three dimensional network.

13. The downhole assembly of claim 12, wherein the matrix material has a cellular nanomatrix, a plurality of dispersed particles dispersed in the cellular nanomatrix, and a solid-state bond layer extending through the cellular nanomatrix between the dispersed particles.

14. The downhole assembly of claim 13, wherein the degradable-on-demand material further includes a sensor, the sensor operative to monitor a parameter of at least one of the degradable-on-demand material, the downhole tool, the downhole assembly, and a well condition.

15. A method of controllably removing the downhole tool of the downhole assembly of claim 1, the method comprising:

disposing the downhole assembly in a downhole environment;

moving the object downhole to engage with the downhole tool and close a switch in the triggering system;

performing a downhole operation using the downhole assembly;

activating the energetic material using the igniter; and degrading the downhole tool.

16. The method of claim 15, wherein closing the switch starts a timer in the triggering system, and activating the energetic material using the igniter occurs at an end of a time period set in the timer.

17. The method of claim 15, wherein the degradable-on-demand material further includes a sensor, and further comprising determining a parameter of the downhole tool, the downhole assembly comprising the downhole tool, a downhole environment, or a combination comprising at least one of the foregoing using the sensor.

18. The method of claim 15, wherein moving the object downhole includes landing a frac ball on a frac plug.

19. The method of claim 15, wherein moving the object downhole includes landing a ball on a sleeve and shifting the sleeve.

20. A method of controllably removing a downhole tool of a downhole assembly, the method comprising:

starting a timer in a triggering system of the downhole assembly for a pre-selected time period, the downhole tool including degradable-on-demand material having a matrix material and an energetic material configured to generate energy upon activation to facilitate degradation of the downhole tool;

disposing the downhole assembly in a downhole environment;

determining if a downhole operation can be completed within the pre-selected time period, and extending the pre-selected time period if the downhole operation cannot be completed within the pre-selected time period;

performing the downhole operation using the downhole assembly;

activating the energetic material at an end of the pre-selected time period or at an end of an extended time period using the igniter; and degrading the downhole tool.

21. The method of claim 20, prior to performing the downhole operation, determining, at the end of the pre-selected time period, if an object usable in the downhole operation has engaged with the triggering system, and extending the predetermined time period if the object has not engaged with the triggering system.

22. The method of claim 21, wherein the object is a ball and the downhole tool is one of a frac plug and a sliding sleeve.

23. A frac plug comprising:

a body formed of a degradable-on-demand material, the degradable-on-demand material including:

a matrix material; and, an energetic material configured to generate energy upon activation to facilitate the degradation of the downhole tool;

a time delay fuse in contact with an uphole end of the body and in contact with the energetic material; and, a ball seat including a piezoelectric material at an uphole end of the time delay fuse;

wherein the piezoelectric material is configured to create a spark and ignite the time delay fuse after a ball is seated on the ball seat and pressure is increased on the ball in a downhole direction.

24. The frac plug of claim 23, wherein the energetic material comprises continuous fibers, wires, or foils, or a combination comprising at least one of the foregoing, which form a three dimensional network; and the matrix material is distributed throughout the three dimensional network.

* * * * *